US008613482B2

(12) United States Patent
Ni

(10) Patent No.: US 8,613,482 B2
(45) Date of Patent: Dec. 24, 2013

(54) CHAIR CHASSIS

(75) Inventor: Yong-Xing Ni, Hangzhou (CN)

(73) Assignee: Hangzhou Zhongtai Industrial Co., Ltd., Zhejiang (CN)

( * ) Notice: Subject to any disclaimer, the term of this patent is extended or adjusted under 35 U.S.C. 154(b) by 256 days.

(21) Appl. No.: 13/018,959

(22) Filed: Feb. 1, 2011

(65) Prior Publication Data

US 2011/0193384 A1 Aug. 11, 2011

(30) Foreign Application Priority Data

Feb. 8, 2010 (CN) ..... 2010 2 0302587 U
Mar. 9, 2010 (CN) ..... 2010 2 0126347 U

(51) Int. Cl.
*A47C 1/024* (2006.01)

(52) U.S. Cl.
USPC ..... 297/302.3; 297/302.1; 297/311

(58) Field of Classification Search
USPC ..... 297/301.3, 301.4, 301.5, 311, 301.1, 297/302.1, 302.3, 302.4, 302.5
See application file for complete search history.

(56) References Cited

U.S. PATENT DOCUMENTS

| | | | | |
|---|---|---|---|---|
| 4,966,411 | A * | 10/1990 | Katagiri et al. | 297/300.7 |
| 5,333,368 | A * | 8/1994 | Kriener et al. | 297/302.1 |
| 6,120,096 | A * | 9/2000 | Miotto | 297/301.4 |
| 6,705,677 | B2 * | 3/2004 | Oshima et al. | 297/300.2 |
| 6,945,602 | B2 * | 9/2005 | Fookes et al. | 297/300.4 |
| 2008/0054700 | A1 * | 3/2008 | Meidan | 297/361.1 |

FOREIGN PATENT DOCUMENTS

| | | | |
|---|---|---|---|
| CN | 2587252 | Y | 11/2003 |

* cited by examiner

*Primary Examiner* — Philip Gabler
(74) *Attorney, Agent, or Firm* — Muncy, Geissler, Olds & Lowe PLLC

(57) ABSTRACT

A chair chassis is revealed. The chair chassis includes a seat base, a middle base and an adjustment member. A sliding plate is connected to each side of the seat base. A sliding slot is arranged at a front and a rear end of each sliding plate and a pulley is arranged transversely between two sliding slots. The two pulleys connect to a tilting board. The middle base between the two sliding plates connects to the tilting board and the two sliding plates by the pulley on the front end. A third pulley slides over a slant part of the middle base. The adjustment member includes a rack, a locking piece and a lock adjustment rod for control of movement of the locking piece to be engaged with and separated from the rack. Thus users with various weights can use the same chair chassis and operate the chair chassis easier.

6 Claims, 6 Drawing Sheets

CHAIR CHASSIS

BACKGROUND OF THE INVENTION

The present invention relates to a chassis, especially to a chair chassis for offering users with different weights comfort and reducing vibration and abrasion while reclining chair backs of chairs.

Generally, a chair chassis includes a plurality of components such as an upper support tray, a lower support rod, a shaft, springs, etc. The upper support tray is fixed with and connected to a chair back so that the chair back is adjusted and reclined to different angles around the shaft. Thus the chair with adjustable recline angles makes users feel more comfortable and relaxed. Refer to Chinese Pat. CN 2587252Y, a support tray for chairs revealed includes a torsion spring so as to adjust the chair back. For users with different weights, various torsion springs are required. Thus the applicability is limited. Moreover, while reclining the chair back, noises are created due to friction of a brake part. And once the chair back is turned back quickly, users sense the vibration of the chair chassis and feel uncomfortable.

SUMMARY OF THE INVENTION

Therefore it is a primary object of the present invention to provide a chair chassis that reduces noises caused by friction and has increased applicability for various users. Although the users have different weights, they feel the same comfort and easy operation.

It is another object of the present invention to provide a chair chassis in which the adjustment occurs with less friction and becomes easier.

It is a further object of the present invention to provide a chair chassis that provides protection against recovery force and enhances the user's comfort.

In order to achieve above objects, a chair chassis of the present invention includes a seat base, a middle base and an adjustment member. The left and the right sides of the seat base are respectively connected to a sliding plate. A first sliding slot and a second sliding slot respectively are arranged at a front end and a rear end of the sliding plate. The first sliding slots of the two sliding plates are symmetrical and so are the second sliding slots. A first pulley is disposed between the two first sliding slots and the first pulley include a shaft and two wheels respectively connected to each of two ends of the shaft and mounted in the first sliding slot. A second pulley is arranged between two second sliding slots and the second pulley include a shaft and two wheels that are respectively connected to each of two ends of the shaft and mounted in the second sliding slot. The shaft of the first pulley and the shaft of the second pulley are respectively connected to and passed by a tilting board so as to connect to a chair back of the chair. Moreover, a slant is disposed on the edge of the rear end of each sliding plate. The middle base is set between the two sliding plates and is connected to the tilting board and the two sliding plates by the first pulley. A slant part on the rear end of the middle base is disposed above the slant on the rear end of each sliding plate. A third pulley is arranged over the slant part. The third pulley includes a shaft and at least one wheel connected to the shaft. The two ends of the shaft are respectively fixed on the left and right sides of the seat base and the wheel is movable and leaning against the slant part. The adjustment member consists of a rack, a locking piece and a lock adjustment rod. The rack is set around the shaft of the first pulley and a plurality of teeth on the rack faces the locking piece. Both left side and the right side of the rack are disposed with a torsion spring. The locking piece is used to lock with the teeth of the rack and the lock adjustment rod is connected to the locking piece for control of the forward/backward movement of the locking piece.

When the chair back is operated to recline and the tilting board is pressed, the middle base is still while the tilting board drives both the first pulley and the second pulley to move within the first sliding slots and the second sliding slots of the two sliding plates. And the third pulley is also sliding over the slant part of the middle base. Moreover, the lock adjustment rod is pulled to drive the locking piece that moves forward and backward and the tilting board is pressed to drive the rack that moves vertically around the shaft of the first pulley. When the locking piece is moved forward to be locked with the teeth of the rack and the device is in the lock status. When the locking piece is moved backward and is separated from the teeth of the rack to be in the unlock status. The adjustment is completed and noises generated by friction of the brake part during the reclining of the chair chassis are reduced.

Furthermore, when a user sits on the chair, a force is applied to the seat base. The force applied to the seat base is increased when the weight is heavier. Thus the force pressed on the tilting board is larger. On the other hand, the force pressed on the tilting board is smaller when the user is light weighted. Thereby forces applied to the seat base and the chair back are automatically adjusted according to the weight of users.

The adjustment member of the chair chassis further includes an elastic part such as two-arm torsion spring. One end of the elastic part is connected to the lock adjustment rod while the other end thereof is connected to the locking piece. Thus the elastic part driven by the pulled lock adjustment rod drives the locking piece to move forward or backward. By the elastic part, the adjustment is with less friction and more energy-saving.

The chair chassis further includes a partition, a cover plate and a block disposed on an inner side of the slant part of the middle base. A through hole for the locking piece moving forward/backward therein is mounted on the partition. The cover plate and the block are respectively arranged above and under the locking piece for receiving the locking piece. The partition is further fixed with an elastic pad having a concave-convex surface that is leaning against by the lock adjustment rod. While being pulled, the lock adjustment rod leans against the concave-convex surface of the elastic pad and moves thereon so as to have certain resistance during the locking and unlocking processes of the lock adjustment rod. Thus the chair chassis is not turned back to the original position immediately when the locking piece is released from the lock status. That means the locking piece and the rack are not separated immediately and a certain force is required to apply to the chair back for separating the locking piece and the rack. Thus a protection for turning back of the locking piece is provided to enhance users' comfort.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
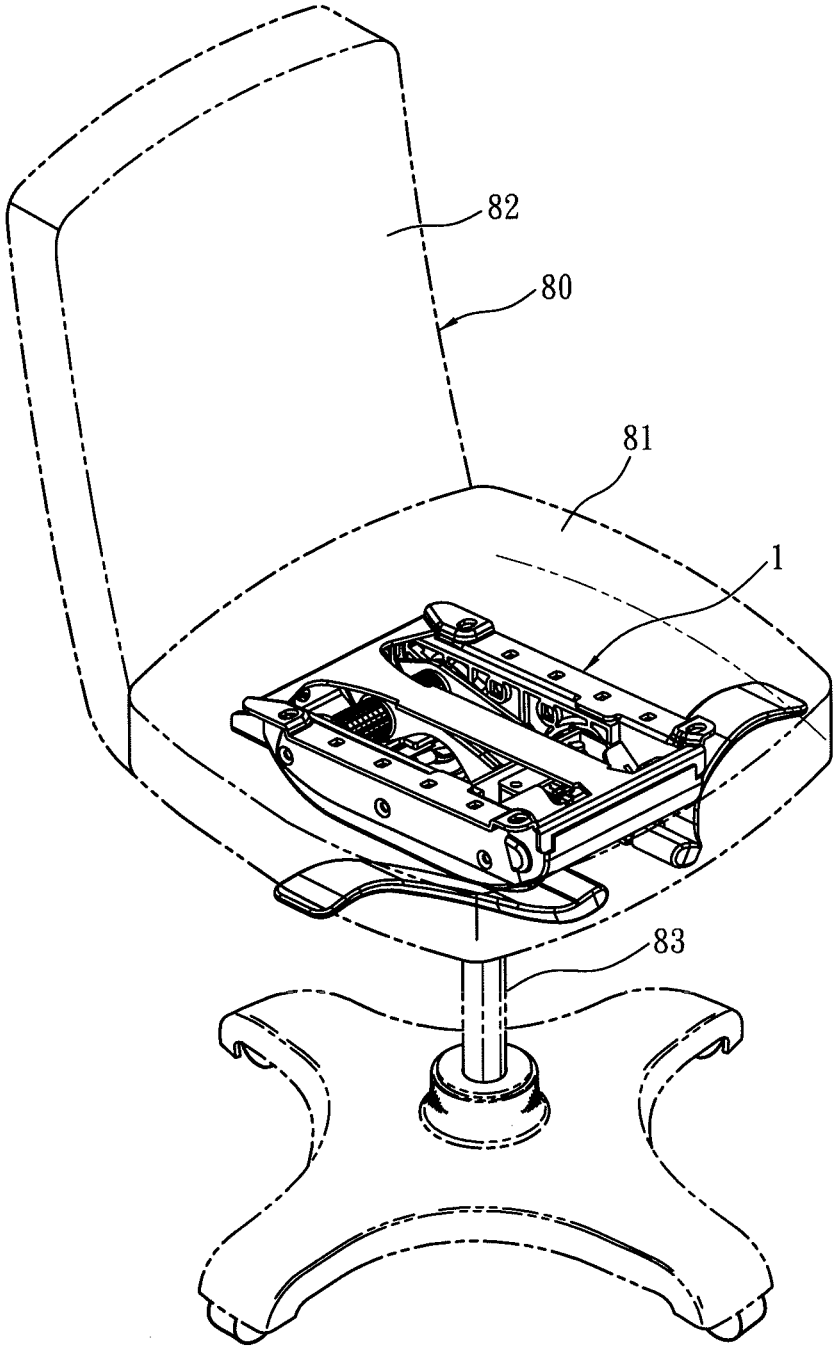
FIG. 1 is a schematic drawing showing an embodiment of a chair chassis fastened on a seat according to the present invention.
Figure 2:
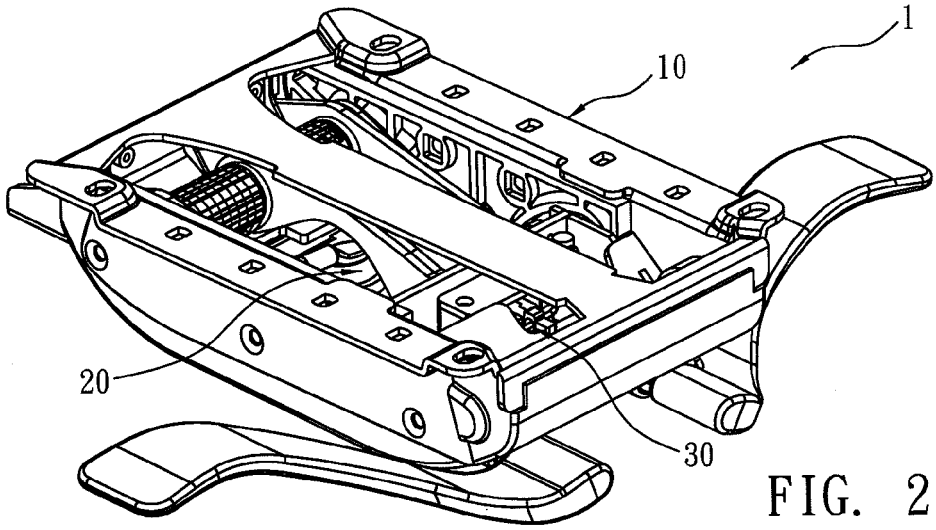
FIG. 2 is a perspective view of an embodiment of a chair chassis according to the present invention.
Figure 6:
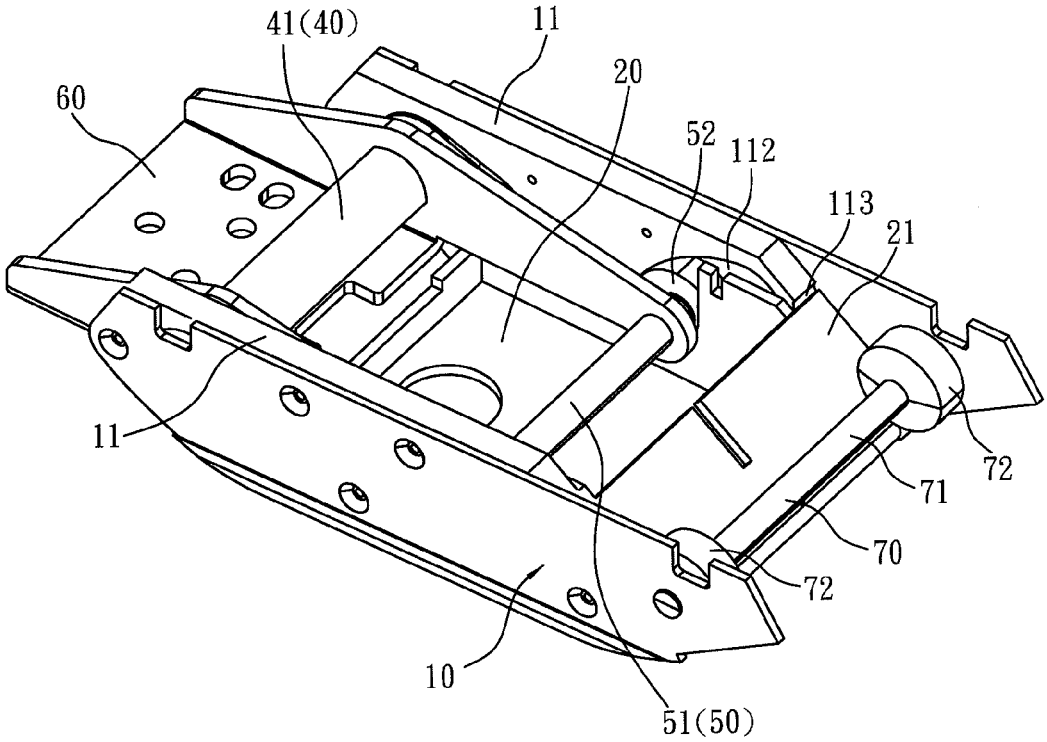
FIG. 6 is a partial enlarged view of the embodiment in FIG. 2 according to the present invention.
Figure 7:
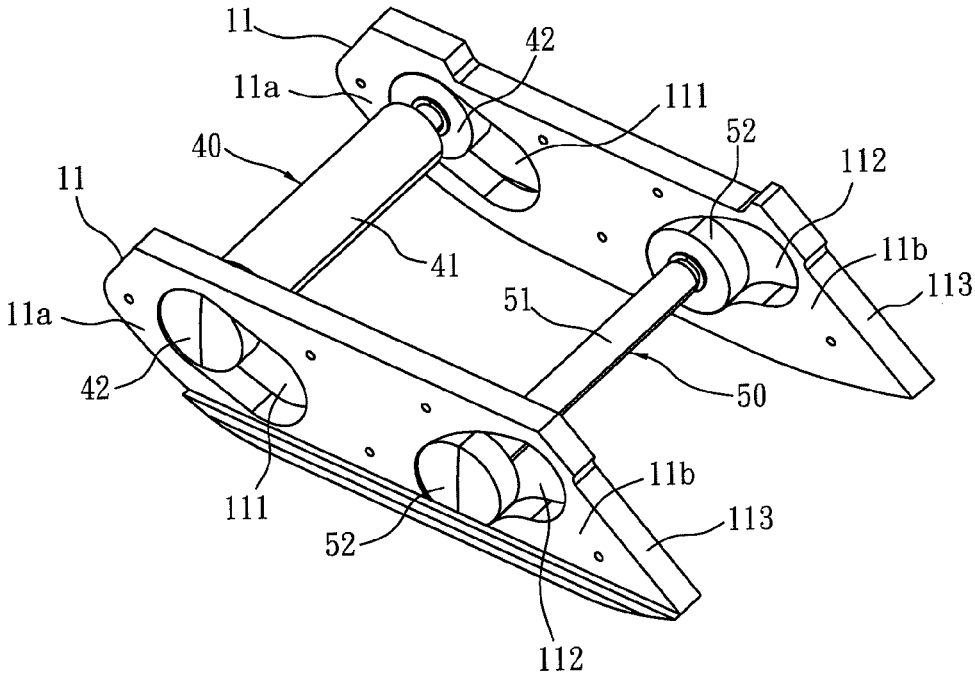
FIG. 7 is another partial enlarged view of the embodiment in FIG. 2 according to the present invention.

Refer from FIG. 1 and FIG. 2, a chair chassis 1 of the present invention includes a seat base 10, a middle base 20 and an adjustment member 30. The seat base is fixed on a bottom of a seat 81 of a chair 80. As shown in FIG. 7, a sliding plate 11 is connected to the left side and the right side of the seat base 10 respectively. A first sliding slot 111 inclined is arranged at a front end 11*a* of the sliding plate 11 and a second sliding slot 112 declined is disposed on a rear end 11*b* of the sliding plate 11. The first sliding slots 111 of the two sliding plate 11 are arranged symmetrical and so are the second sliding slots 112. A first pulley 40 is disposed between the two first sliding slots 111. The first pulley 40 consists of a shaft 41 and two wheels 42 that are respectively connected to each of two ends of the shaft 41 and mounted in each first sliding slot 111. Similarly, a second pulley 50 is set between the two second sliding slots 112. The second pulley 50 is composed of a shaft 51 and two wheels 52 that are respectively connected to each of two ends of the shaft 51 and located in each second sliding slot 112. Refer to FIG. 6, the shaft 41 of the first pulley 40 and the shaft 51 of the second pulley 51 are respectively connected to and passed by a tilting board 60 so as to connect to a chair back 82 of the chair 80. Moreover, a slant 113 is disposed on the edge of the rear end 11*b* of each sliding plate 11. The angle between the slant 113 and the horizontal plane ranges from 30 degrees to 40 degrees and 38.5 degrees is preferred. As to the wheel 42 of the first pulley 40, the diameter ranges from 25 mm to 35 mm, and 32 mm is preferred. The diameter of the wheel 52 of the second pulley 50 also ranges from 25 mm to 35 mm while 31.8 mm is preferred. The inclined and declined designs of the first sliding slot 111 and the second sliding slot 112 allow the first pulley 40 and the second pulley 50 sliding more smoothly while the tilting board 60 is pressed.

Refer to FIG. 1 and FIG. 6, the middle base 20 is connected a leg 83 of the chair 80. The middle base 20 is set between the two sliding plates 11 and is passed through by the shaft 41 of the first pulley 40 to be movably connected to the tilting board 60, and the two sliding plates 11. The middle base 20 includes a slant part 21 on the rear end thereof and the slant part 21 is disposed above the slant 113 on the rear end 11*b* of each sliding plate 11. A third pulley 70 is arranged over the slant part 21. The third pulley 70 includes a shaft 71 and at least one wheel 72 arranged at the shaft 71. The two ends of the shaft 71 are fixed on the left and right sides of the seat base 10 respectively and the wheel 72 is leaning against the slant part 21 and is movable. As shown in the FIG. 6, the shaft 71 is connected with two wheels 72 respectively set on the left end and the right end of the shaft. The diameter of the wheel 72 of the third pulley 70 ranges from 25 mm to 35 mm and 31.8 mm is optimal.

Figure 3:
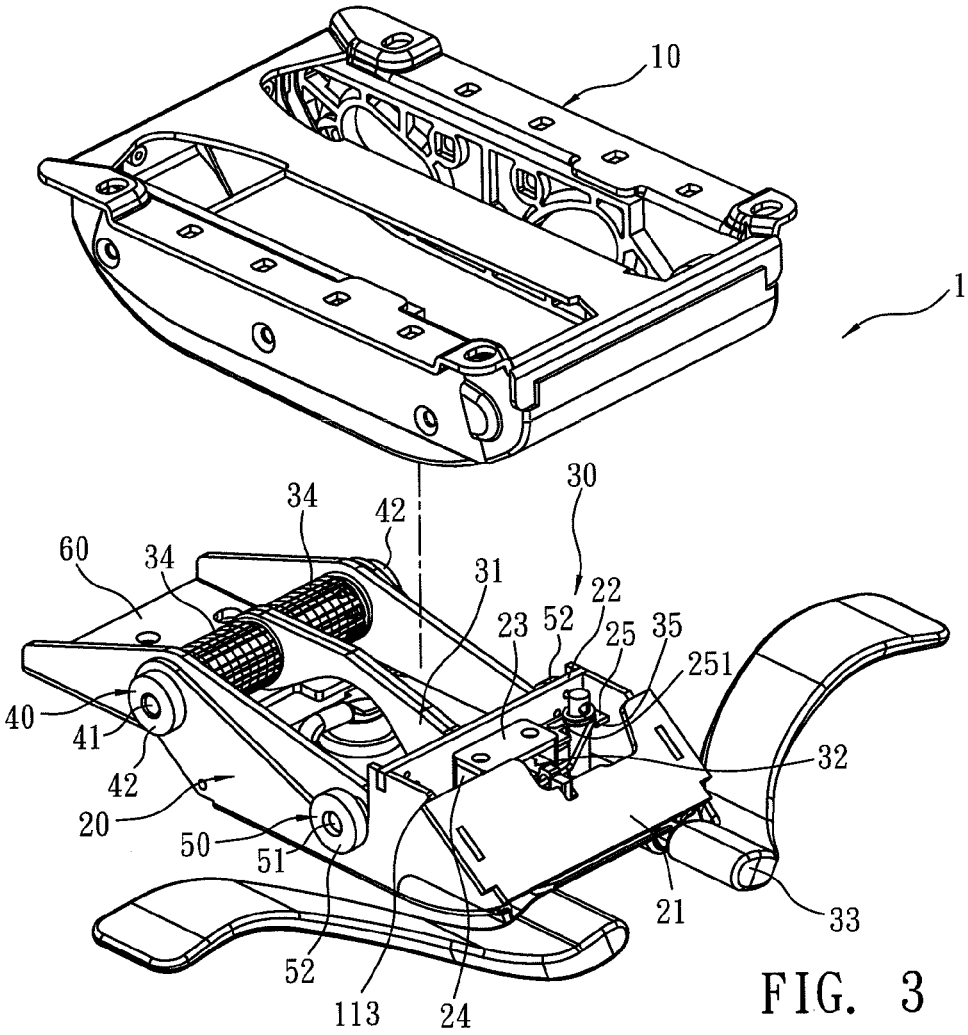
FIG. 3 is an explosive view of an embodiment of a chair chassis according to the present invention.
Figure 4:
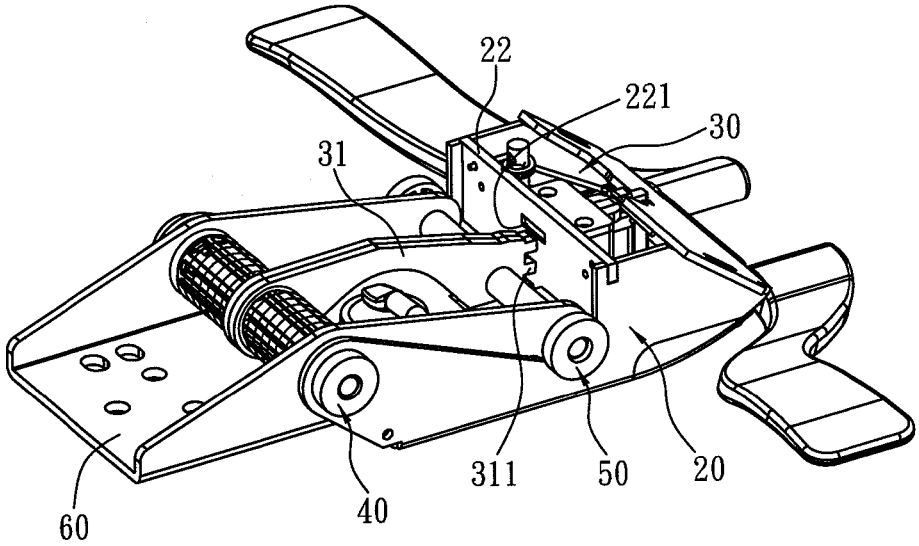
FIG. 4 is a rear view of the embodiment in FIG. 3 without a seat base according to the present invention.
Figure 5:
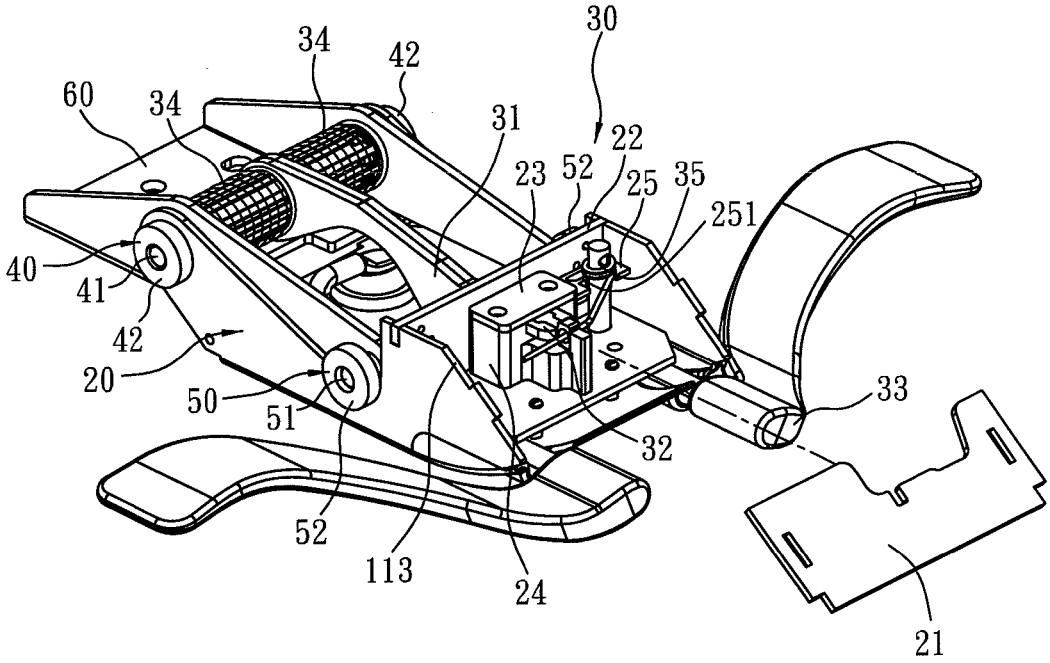
FIG. 5 is an explosive view of the embodiment in FIG. 3 without a seat base and having a separated slant part according to the present invention.

Refer from FIG. 3 to FIG. 5, the adjustment member 30 includes a rack 31, a locking piece 32 and a lock adjustment rod 33. The rack 31 is set around the middle part of the shaft 41 of the first pulley 40 and a plurality of teeth 31 on the rack 31 faces the locking piece 32. A torsion spring 34 is disposed on the left side and the right side of the rack 31. The angle between arms of the torsion spring 34 ranges from 40 degrees to 60 degrees. The locking piece 32 is locked with the teeth 311 of the rack 31 while the lock adjustment rod 33 is connected to the locking piece 32 for control of the forward/backward movement of the locking piece 32. When the locking piece 32 moves forward, it is locked with the teeth 311 of the rack 31 to be in the lock status. When the locking piece 32 moves backward to be separated with the teeth 311 of the rack 31, the locking piece 32 is in the unlock status. The number of the plurality of teeth 311 on the rack 31 is used as the number of adjustment stages between the locking piece 32 and the rack 31.

Still refer from FIG. 3 to FIG. 5, the adjustment member 30 further includes an elastic part 35 such as two-arm torsion spring and the angle between its two arms is from 80 degrees to 120 degrees. One end of the elastic part 35 is connected to the lock adjustment rod 33 while the other end thereof is connected to the locking piece 32. By the elastic part 35, the movement of the locking piece 32 driven by the lock adjustment rod 33 is with less friction and more energy-saving.

Refer to FIG. 4 and FIG. 5, a partition 22, a cover plate 23 and a block 24 are disposed on an inner side of the slant part 21 of the middle base 20. A through hole 221 is mounted on the partition 22 so as to allow the locking piece 32 moving forward/backward inside the through hole 221. The cover plate 23 and the block 24 are respectively arranged above and under the locking piece 32 for receiving and loading the locking piece 32. Moreover, the partition 22 is further fixed with an elastic pad 25 made from plastic material, but not limited. The elastic pad 25 includes a concave-convex surface 251 that is leaning against by the lock adjustment rod 33. The lock adjustment rod 33 leans against the concave-convex surface 251 and moves thereon so as to have certain resistance that provides protection for turning back of the locking piece.

Figure 8:
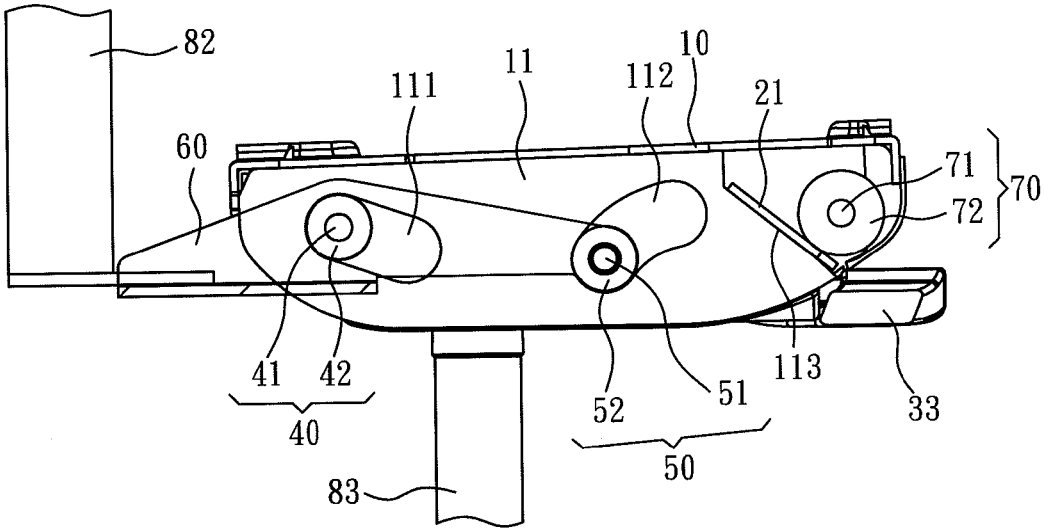
FIG. 8 and FIG. 9 are schematic drawings showing movement of a first pulley and a second pulley within a first sliding slot and a second sliding slot while a tilting board being pressed according to the present invention.
Figure 9:
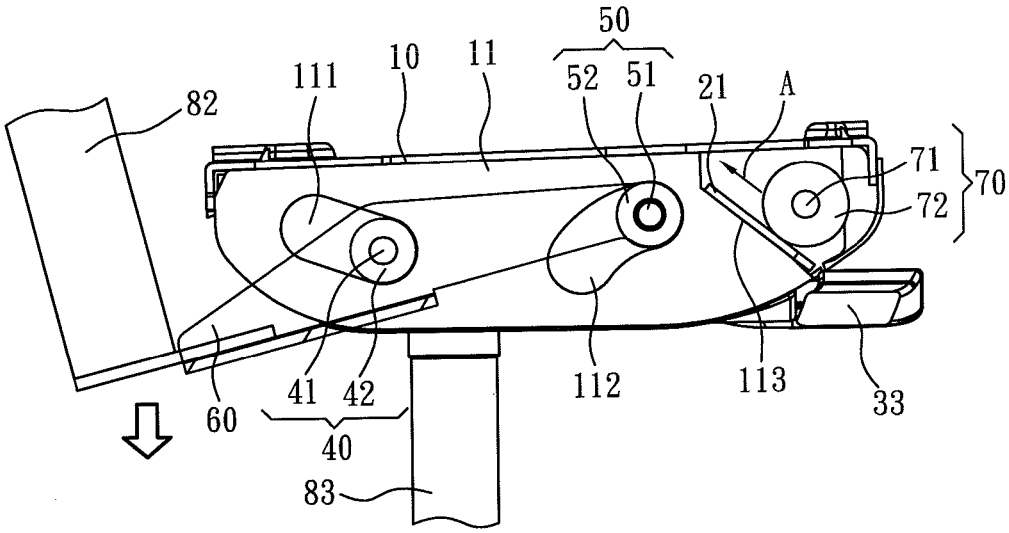

Refer to FIG. 8 and FIG. 9, when the chair back 82 is reclined and the tilting board 60 is pressed, the middle base 20 remains still and the tilting board 60 drives both the first pulley 40 and the second pulley 50 respectively to move within the first sliding slot 111 and the second sliding slot 112. And the third pulley 70 is also sliding over the slant part 21 of the middle base 20, as the arrow A indicates in the FIG. 9.

Figure 10:
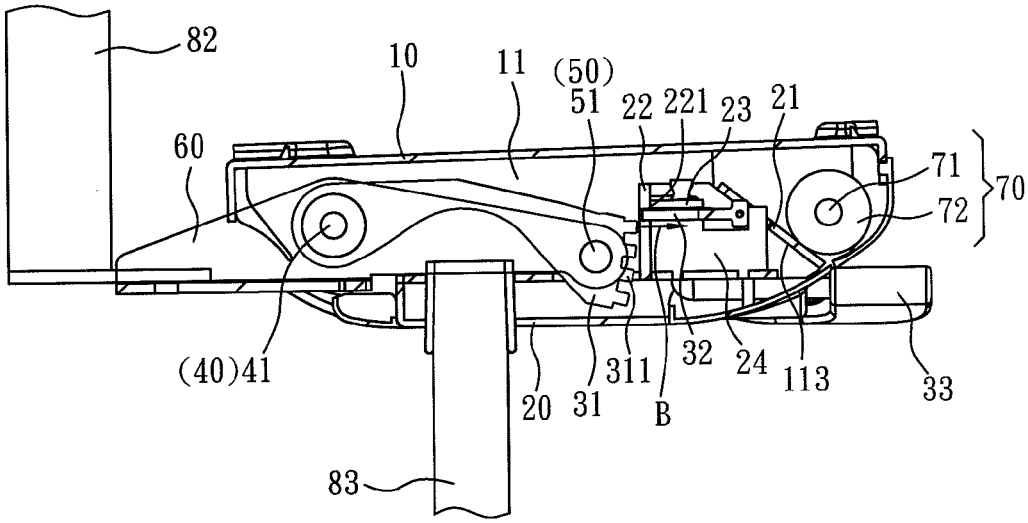
FIG. 10 and FIG. 11 are schematic drawings showing movement of a rack and a locking piece of an adjustment member when a tilting board is pressed according to the present invention.
Figure 11:
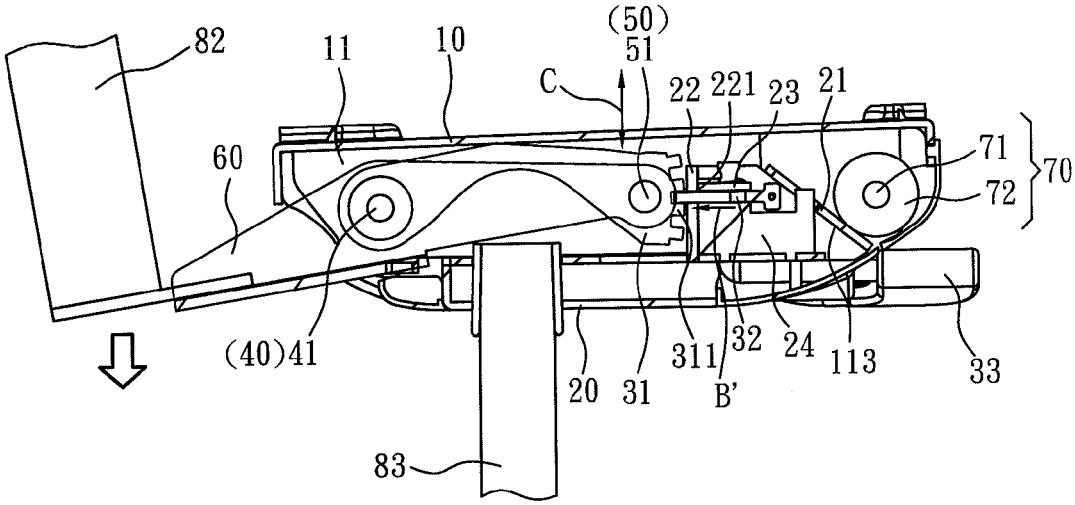

As shown in the FIG. 10, the lock adjustment rod 33 is pulled to drive the locking piece 32 moving backward, as the arrow B indicates. Thus the locking piece 32 is separated from the teeth 311 of the rack 31 to be in the unlock status. Refer to FIG. 11, the tilting board 60 is pressed to drive the rack 31 moving vertically around the shaft 41 of the first pulley 40, as the arrow C indicates. Then the lock adjustment rod 33 is pulled to drive the locking piece 32 moving forward, as the arrow B' indicates. Thus the locking piece 32 is locked with the teeth 311 of the rack 31 to be in the lock status. Thereby noises generated by friction during the adjustment process for locking and unlocking are reduced. In contrast to the present invention, noises are generated due to fastening of the brake part in the conventional chair chassis during the chair reclining process.

When users sit on the chair 80, a force is applied to the seat base 10. When the user is heavy, the force applied to the seat base 10 is larger so that the force pressing on the slant part 21 of the middle base 20 is also larger and the force that presses on the tilting board 60 is larger. When the user is lightweight, the force applied to the seat base 10 is smaller. Thus the force pressing on the slant part 21 of the middle base 20 is also smaller and the force that presses on the tilting board 60 is smaller. Thereby forces applied to the seat base 10 and the chair back 82 are automatically adjusted according to the weight of users. Therefore the chair chassis is suitable for users with various weights and the chair chassis offers different users the same comfort and easiness of use. The applications of the chair chassis are increased.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A chair chassis comprising a seat base, a first pulley, a second pulley, a tilting board, a middle base, a third pulley and an adjustment member, wherein:

the seat base is fixedly connected to a bottom of a seat of the chair and has two sliding plates connected to the left side and the right side of the seat base respectively, wherein two first sliding slots are inclined and symmetrically disposed on the front end of each of the two sliding plates, two second sliding slots are declined and symmetrically disposed on the rear end of each of the sliding plate, and two slants are symmetrically disposed on the edge of the rear end of each of the sliding plates;

the first pulley is disposed between the two first sliding slots and consists of a shaft and two wheels, wherein the two wheels are rotatably connected to each of two ends of the shaft, and each wheel is slidably located in each first sliding slot;

the second pulley is disposed between the two second sliding slots and consists of a shaft and two wheels, wherein the two wheels are rotatably connected to each of two ends of the shaft, and each wheel is slidably located in each second sliding slot;

the tilting board is fixedly connected to a chair back of the chair and is fixedly connected to the shaft of the first pulley and the shaft of the second pulley;

the middle base is fixedly connected to a leg of the chair and is set between the two sliding plates of the seat base and rotatably connected to each of two ends of the shaft of the first pulley, such that when the chair back of the chair is reclined by user, the tilting board is pressed synchronously to be reclined by rotating about the shaft which is rotatably supported by the middle base; the middle base includes a slant part on the rear end thereof and the slant part is disposed above the slant on the rear end of each sliding plate;

the third pulley is arranged over the slant part of the middle base and includes a shaft and at least one wheel disposed on the shaft, the two ends of the shaft are fixed on the left and right sides of the seat base and the at least one wheel is movably leaning against the slant part of the middle base; and the adjustment member includes a rack, a locking piece and a lock adjustment rod, wherein the rack is connected to the shaft of the first pulley and the shaft of the second pulley, and disposed with a torsion spring set on the shaft of the first pulley and on a left side and a right side of the rack; a plurality of teeth are disposed on a rear end of the rack for facing the locking piece; wherein the locking piece is used to lock or unlock with the teeth of the rack while the lock adjustment rod is connected to the locking piece for control of the forward/backward movement of the locking piece;

wherein when the chair back of the chair is reclined by a user who sits on the seat of the chair, the tilting board is synchronously pressed and reclined to rotate about the shaft of the first pulley while the middle base and the shaft of the first pulley remain still, such that the seat base will move while the two wheels of the first pulley and the two wheels of the second pulley slide relatively within the first sliding slot and the second sliding slot of the seat base respectively, and the at least one wheel of the third pulley slides over and leaned against the slant part of the middle base with the user's weight pressed on the seat base;

wherein when the lock adjustment rod is pulled to drive the locking piece moving backward, the locking piece is separated from the teeth of the rack to be in the unlock condition, then the user enables the chair back of the chair and the tilting board to be synchronously pressed and reclined to rotate about the shaft of the first pulley, the tilting board is then pressed to drive the rack moving vertically around the shaft of the first pulley, the lock adjustment rod is then pulled to drive the locking piece moving forward, the locking piece is then locked with the teeth of the rack to be in the lock condition.

2. The device as claimed in claim 1, wherein an angle between the slant arranged at the edge of the rear end of the sliding plate and a horizontal plane is in the range of from 30 degrees to 40 degrees.

3. The device as claimed in claim 1, wherein a diameter of the wheel of the first pulley, a diameter of the wheel of the second pulley and a diameter of the wheel of the third pulley all fall into the range from 25 mm to 35 mm.

4. The device as claimed in claim 1, wherein the adjustment member further includes an elastic part, wherein one end of the elastic part is connected to the lock adjustment rod while the other end thereof is connected to the locking piece.

5. The device as claimed in claim 4, wherein the elastic part is a two-arm torsion spring and an angle between the two arms of the two-arm torsion spring is in the range of from 80 degrees to 120 degrees.

6. The device as claimed in claim 1, wherein an inner side of the slant part of the middle base is further disposed with a partition, a cover plate and a block, wherein a through hole for the locking piece moving forward/backward therein is mounted on the partition; the cover plate is arranged above the locking piece and the block is arranged under the locking piece for receiving the locking piece; the partition is further fixed with an elastic pad having a concave-convex surface and the lock adjustment rod leans against the concave-convex surface.

* * * * *